US006338668B1

(12) United States Patent
Lin et al.

(10) Patent No.: US 6,338,668 B1
(45) Date of Patent: Jan. 15, 2002

(54) IN-LINE CHEMICAL MECHANICAL POLISH (CMP) PLANARIZING METHOD EMPLOYING INTERPOLATION AND EXTRAPOLATION

(75) Inventors: Chih-Lung Lin, Taipei; Wen-Cheng Chien, Kaohsiung, both of (TW)

(73) Assignee: Taiwan Semiconductor Manufacturing Company, Ltd, Hsin Chu (TW)

( * ) Notice: Subject to any disclaimer, the term of this patent is extended or adjusted under 35 U.S.C. 154(b) by 0 days.

(21) Appl. No.: 09/639,864

(22) Filed: Aug. 16, 2000

(51) Int. Cl.[7] ..... B24B 49/00

(52) U.S. Cl. ..... 451/9; 451/10; 451/11; 451/41

(58) Field of Search ..... 451/5, 8, 9, 10, 451/11, 41, 59, 63; 438/691, 692; 156/626, 627

(56) References Cited

U.S. PATENT DOCUMENTS 5,266,532 A * 11/1993 Russell et al.
5,413,941 A 5/1995 Koos et al.
5,483,568 A * 1/1996 Yano et al. ..... 451/8
5,640,242 A * 6/1997 O'Boyle et al. ..... 356/381
5,722,875 A * 3/1998 Iwashita et al. ..... 451/8
6,007,405 A 12/1999 Mei
6,007,408 A 12/1999 Sandhu
6,010,538 A 1/2000 Sun et al.
6,015,333 A * 1/2000 Obeng ..... 451/8
6,048,789 A * 4/2000 Vines et al. ..... 438/633
6,120,348 A * 9/2000 Fujita et al. ..... 451/5

* cited by examiner

*Primary Examiner*—Eileen P. Morgan
(74) *Attorney, Agent, or Firm*—Tung & Associates

(57) ABSTRACT

Within a chemical mechanical polish (CMP) method there is first provided a first control substrate, a first series of product substrates and a second control substrate. There is then sequentially chemical mechanical polish (CMP) planarized, while employing a chemical mechanical polish (CMP) planarizing method, the first control substrate to provide a planarized first control substrate, the first series of product substrates to provide a planarized first series of product substrates and the second control substrate to provide a planarized second control substrate. There is then determined, for the planarized first control substrate and the planarized second control substrate, a corresponding first value of a parameter within the chemical mechanical polish (CMP) planarizing method and a corresponding second value of the parameter within the chemical mechanical polish (CMP) planarizing method. There may then be interpolated or extrapolated from the first value of the parameter and the second value of the parameter to provide an interpolated value of the parameter for a planarized first product substrate within the planarized first series of product substrates or an extrapolated value of the parameter which may be employed for planarizing with enhanced uniformity a second product substrate within a second series of product substrates.

15 Claims, 3 Drawing Sheets

IN-LINE CHEMICAL MECHANICAL POLISH (CMP) PLANARIZING METHOD EMPLOYING INTERPOLATION AND EXTRAPOLATION

BACKGROUND OF THE INVENTION

1. Field of the Invention

The present invention relates generally to chemical mechanical polish (CMP) planarizing methods for forming planarized layers within microelectronic fabrications. More particularly, the present invention relates to chemical mechanical polish (CMP) planarizing methods for forming, with enhanced properties, planarized layers within microelectronic fabrications.

2. Description of the Related Art

Microelectronic fabrications are formed from microelectronic substrates over which are formed patterned microelectronic conductor layers which are separated by microelectronic dielectric layers, As microelectronic fabrication integration levels have increased and microelectronic device and patterned microelectronic conductor layer dimensions have decreased, it has become increasingly common within the art of microelectronic fabrication to employ planarizing methods, such as but not limited to chemical mechanical polish (CMP) planarizing methods, for forming planarized microelectronic layers within microelectronic fabrications. In turn, planarized microelectronic layers are desirable within microelectronic fabrications insofar as planarized microelectronic layers typically provide superior substrate surfaces upon which may be formed additional microelectronic layers within microelectronic fabrications.

While planarizing methods, such as but not limited to chemical mechanical polish (CMP) planarizing methods, are thus highly desirable in the art of microelectronic fabrication, planarizing methods, and in particular chemical mechanical polish (CMP) planarizing methods, are not entirely without problems in the art of microelectronic fabrication. In that regard, it is often difficult to form within microelectronic fabrications chemical mechanical polish (CMP) planarized layers with enhanced chemical mechanical polish (CMP) planarizing uniformity, such as but not limited to enhanced across-substrate chemical mechanical polish (CMP) planarizing uniformity, enhanced substrate-to-substrate within lot chemical mechanical polish (CMP) planarizing uniformity and enhanced lot-to-lot chemical mechanical polish (CMP) planarizing uniformity.

It is thus desirable within the art of microelectronic fabrication to provide chemical mechanical polish (CMP) planarizing methods, materials and apparatus which may be employed for forming within microelectronic fabrications chemical mechanical polish (CMP) planarized microelectronic layers with enhanced uniformity.

It is towards the foregoing object that the present invention is directed.

Various chemical mechanical polish (CMP) planarizing methods, materials and apparatus have been disclosed in the art of microelectronic fabrication for forming, with desirable properties, chemical mechanical polish (CMP) planarized microelectronic layers within microelectronic fabrications.

For example, Koos et al., in U.S. Pat. No. 5,413,941, discloses a chemical mechanical polish (CMP) planarizing method and a chemical mechanical polish (CMP) planarizing apparatus for forming, with an enhanced chemical mechanical polish (CMP) planarizing endpoint detection capability, a chemical mechanical polish (CMP) planarized microelectronic layer within a microelectronic fabrication. To realize the foregoing object, the chemical mechanical polish (CMP) planarizing method and the chemical mechanical polish (CMP) planarizing apparatus employ an optical endpoint detection scheme which in turn employs a laser light beam reflected from an edge of a substrate which is chemical mechanical polish (CMP) planarized while employing the chemical mechanical polish (CMP) planarizing method and the chemical mechanical polish (CMP) planarizing apparatus, and further wherein the laser light beam has an incidence of at least about 70 degrees with respect to a normal to a surface of the substrate which is chemical mechanical polish (CMP) planarized while employing the chemical mechanical polish (CMP) planarizing method and the chemical mechanical polish (CMP) planarizing apparatus.

In addition, Mei, in U.S. Pat. No. 6,007,405, also discloses a chemical mechanical polish (CMP) planarizing method and a chemical mechanical polish (CMP) planarizing apparatus for forming, with an enhanced chemical mechanical polish (CMP) planarizing endpoint detection capability, a chemical mechanical polish (CMP) planarized microelectronic layer within a microelectronic fabrication. To realize the foregoing object, the chemical mechanical polish (CMP) planarizing method and the chemical mechanical polish (CMP) planarizing apparatus employ an electrical resistive lapping monitor when chemical mechanical polish (CMP) planarizing a microelectronic layer within a microelectronic fabrication while employing the chemical mechanical polish (CMP) planarizing method and the chemical mechanical polish (CMP) planarizing apparatus.

Further, Sandhu, in U.S. Pat. No. 6,007,408, similarly also discloses a chemical mechanical polish (CMP) planarizing method and a chemical mechanical polish (CMP) planarizing apparatus for forming, with an enhanced chemical mechanical polish (CMP) planarizing endpoint detection capability, a chemical mechanical polish (CMP) planarized microelectronic layer within a microelectronic fabrication. To realize the foregoing object, the chemical mechanical polish (CMP) planarizing method and the chemical mechanical polish (CMP) planarizing apparatus employ a thermal emission measurement from a thermally sensitive component formed upon an exposed surface of a substrate which is chemical mechanical polish (CMP) planarized while employing the chemical mechanical polish (CMP) planarizing method and the chemical mechanical polish (CMP) planarizing apparatus.

Finally, Sun et al., in U.S. Pat. No. 6,010,538, similarly also disclose a chemical mechanical polish (CMP) planarizing method and a chemical mechanical polish (CMP) planarizing apparatus for forming, with an enhanced chemical mechanical polish (CMP) planarizing endpoint detection capability, a chemical mechanical polish (CMP) planarized microelectronic layer within a microelectronic fabrication. To realize the foregoing object, the chemical mechanical polish (CMP) planarizing method and the chemical mechanical polish planarizing apparatus employ a radiation sensor coupled to a chuck which is employed for rotating a substrate within the chemical mechanical polish (CMP) planarizing method and the chemical mechanical polish (CMP) planarizing apparatus, and further wherein the radiation sensor is coupled with a chemical mechanical polish (CMP) planarizing apparatus controller absent use of physical transmission media such as an electrical cabling assembly or an optical fiber cabling assembly.

Desirable in the art of microelectronic fabrication are additional methods, materials and apparatus which may be employed for forming, with enhanced uniformity, chemical mechanical polish (CMP) planarized microelectronic layers within microelectronic fabrications.

It is towards the foregoing object that the present invention is directed.

SUMMARY OF THE INVENTION

A first object of the present invention is to provide a chemical mechanical polish (CMP) planarizing method for forming a chemical mechanical polish (CMP) planarized microelectronic layer within a microelectronic fabrication.

A second object of the present invention is to provide a chemical mechanical polish (CMP) planarizing method in accord with the first object of the present invention, wherein the chemical mechanical polish (CMP) planarized microelectronic layer is formed with enhanced uniformity.

A third object of the present invention is to provide a chemical mechanical polish (CMP) planarizing method in accord with the first object of the present invention and the second object of the present invention, which method is readily commercially implemented.

In accord with the objects of the present invention, there is provided by the present invention a chemical mechanical polish (CMP) planarizing method for forming a chemical mechanical polish (CMP) planarized layer within a microelectronic fabrication.

To practice a first embodiment of the present invention, there is first provided a first control substrate, a first series of product substrates and a second control substrate. There is then sequentially chemical mechanical polish (CMP) planarized, while employing a chemical mechanical polish (CMP) planarizing method, the first control substrate to provide a planarized first control substrate, the first series of product substrates to provide a planarized first series of product substrates and the second control substrate to provide a planarized second control substrate. There is then determined for the planarized first control substrate and the planarized second control substrate a corresponding first value of a parameter within the chemical mechanical polish (CMP) planarizing method and a corresponding second value of the parameter within the chemical mechanical polish (CMP) planarizing method. Finally, there is then interpolated between the first value of the parameter and the second value of the parameter to determine an interpolated value of the parameter which corresponds with a planarized first product substrate within the planarized first series of product substrates.

To practice a second embodiment of the present invention, there is provided in conjunction with the first embodiment of the present invention a second series of product substrates which is planarized after the second control substrate while employing the chemical mechanical polish (CMP) planarizing method, but wherein there is extrapolated from the first value of the parameter and the second value of the parameter an extrapolated value of the parameter which serves as a guide to control the chemical mechanical polish (CMP) planarizing method such that a second product substrate within the second series of product substrates is formed with enhanced uniformity.

There is provided by the present invention a chemical mechanical polish (CMP) planarizing method for forming a chemical mechanical polish (CMP) planarized microelectronic layer within a microelectronic fabrication, wherein the chemical mechanical polish (CMP) planarized microelectronic layer is formed with enhanced uniformity. The present invention realizes the foregoing object by employing at least one of: (1) an interpolation between; and (2) an extrapolation from, a pair of measured values of a parameter within a chemical mechanical polish (CMP) planarizing method employed with respect to a pair of control substrates to provide at least one of: (1)an interpolated value of the parameter; and (2) an extrapolated value of the parameter, within the chemical mechanical polish (CMP) planarizing method with respect to a product substrate within a series of product substrates. By determining an interpolated value of the parameter, further processing of the chemical mechanical polish (CMP) planarized product substrate (or alternatively a chemical mechanical polish (CMP) planarized microelectronic layer formed thereupon) may be effected within enhanced process control and thus enhanced uniformity. Similarly, by determining an extrapolated of the parameter, additional process control may also be effected to provide a chemical mechanical polish (CMP) planarized product substrate For alternatively a chemical mechanical polish (CMP) planarized microelectronic layer formed thereupon) with enhanced uniformity.

The method of the present invention is readily commercially implemented. The present invention employs methods and materials as are generally known in the art of microelectronic fabrication, but employed within the context of specific process controls which provide the present invention. Since it is thus at least in part a process control which provides the present invention, rather than the existence of methods and materials which provides the present invention, the method of the present invention is readily commercially implemented.

BRIEF DESCRIPTION OF THE DRAWINGS

The objects, features and advantages of the present invention are understood within the context of the Description of the Preferred Embodiment, as set forth below. The Description of the Preferred Embodiment is understood within the context of the accompanying drawings, which form a material part of this disclosure, wherein.

DESCRIPTION OF THE PREFERRED EMBODIMENT

There is provided by the present invention a chemical mechanical polish (CMP) planarizing method for forming a chemical mechanical polish (CMP) planarized microelectronic layer within a microelectronic fabrication, wherein the chemical mechanical polish (CMP) planarized microelectronic layer is formed with enhanced uniformity. The present invention realizes the foregoing object by employing at least one of: (1) an interpolation between; and (2) an extrapolation from, a pair of measured values of a parameter within a chemical mechanical polish (CMP) planarizing method employed with respect to a pair of control substrates, to provide at least one of: (1) an interpolated value of the parameter; and (2) an extrapolated value of the parameter, within the chemical mechanical polish (CMP) planarizing method with respect to a product substrate within a series of product substrates. By determining an interpolated value of the parameter, further processing of the chemical mechanical polish (CMP) planarized product substrate (or alternatively a chemical mechanical polish (CMP) planarized microelectronic layer formed thereupon) may be effected within enhanced process control and thus enhanced uniformity. Similarly, by determining an extrapolated of the parameter, additional process control may also be effected to provide a chemical mechanical polish (CMP) planarized product substrate (or alternatively a chemical mechanical polish (CMP) planarized microelectronic layer formed thereupon) with enhanced uniformity.

First Preferred Embodiment

Figure 1:
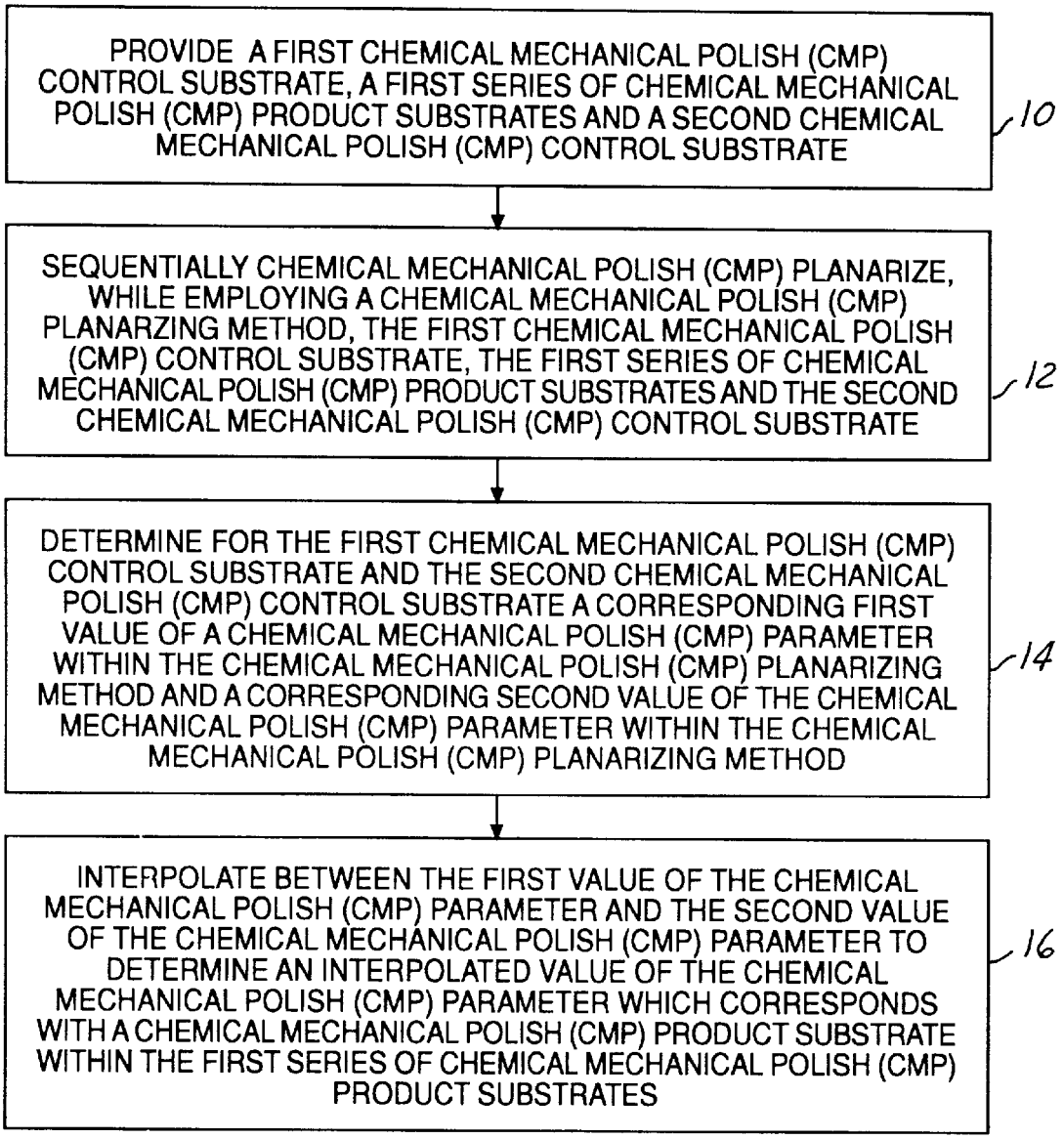
FIG. 1 shows a schematic process flow diagram which defines a series of process steps in accord with a first preferred embodiment of the present invention.

Referring now to FIG. 1, there is shown a schematic process flow diagram which defines a series of process steps in accord with a first preferred embodiment of the present invention.

As is illustrated within the schematic process flow diagram of FIG. 1, and in conjunction with the process step which corresponds with reference numeral 10, there is first provided within the first preferred embodiment of the present invention a first chemical mechanical polish (CMP) control substrate, a first series of chemical mechanical polish (CMP) product substrates and a second chemical mechanical polish (CMP) control substrate.

Figure 3:
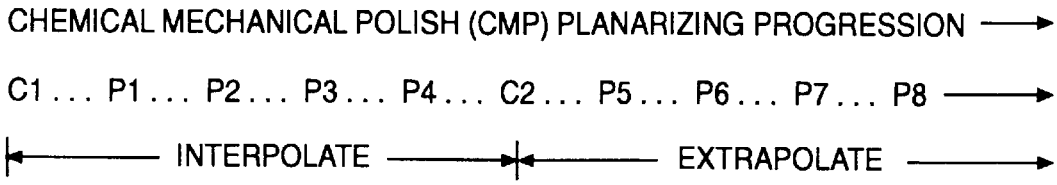
FIG. 3 shows a schematic flow diagram for a series of chemical mechanical polish (CMP) substrates in accord with the first preferred embodiment of the invention and the second preferred embodiment of the invention.

For purposes of clarity, and within the context of FIG. 3 which shows a schematic flow diagram for a series of chemical mechanical polish (CMP) substrates in accord with the first preferred embodiment of the present invention and a second preferred embodiment of the present invention, the first chemical polish (CMP) control substrate is denoted as Cl, the first series of chemical mechanical polish (CMP) product substrates is denoted as P1, P2, P3 and P4, and the second chemical mechanical polish (CMP) control substrate is denoted as C2. Typically and preferably, the first series of chemical mechanical polish (CMP) product substrates comprises from about 4 to about 8 substrates (or lots of substrates to be equivalently processed).

Within the present invention and the first preferred embodiment of the present invention with respect to each of the first chemical mechanical polish (CMP) control substrate C1, the first series of chemical mechanical polish (CMP) product substrates P1, P2, P3 and P4 and the second chemical mechanical polish (CMP) control substrate C2, each of the first chemical mechanical polish (CMP) control substrate C1, the first series of chemical mechanical polish (CMP) product substrates P1, P2, P3 and P4 and the second chemical mechanical polish (CMP) control substrate C2 may comprise substrates as are employed within microelectronic fabrications selected from the group including but not limited to integrated circuit microelectronic fabrications, ceramic substrate microelectronic fabrications, solar cell optoelectronic microelectronic fabrications, sensor image array optoelectronic microelectronic fabrications and display image array optoelectronic microelectronic fabrications.

Similarly, within the present invention and the first preferred embodiment of the present invention, each substrate within the first chemical mechanical polish (CMP) control substrate C1, the first series of chemical mechanical polish (CMP) product substrates P1, P2, P3 and P4 and the second chemical mechanical polish (CMP) control substrate C2 may consist of a substrate alone as employed within a microelectronic fabrication within which is employed the substrate, or in the alternative, each substrate within the first chemical mechanical polish (CMP) control substrate C1, the first series of chemical mechanical polish (CMP) product substrates P1, P2, P3 and P4 and the second chemical mechanical polish (CMP) control substrate C2 may comprise the substrate ad employed within the microelectronic fabrication within which is employed the substrate, wherein the substrate has formed thereupon and/or thereover any of several additional microelectronic layers as are conventionally employed within the microelectronic fabrication within which is employed the substrate. Similarly with the substrate alone as employed within the microelectronic fabrication, such additional microelectronic layers may be formed from microelectronic materials selected from the group including but not limited to microelectronic conductor materials, microelectronic semiconductor materials and microelectronic dielectric materials, typically and preferably formed to a thickness of from about 2,000 to about 20,000 angstroms.

Similarly, and as is also not otherwise specifically illustrated with respect to the present invention or the preferred embodiments of the present invention, a substrate which may be employed for any of the first chemical mechanical polish (CMP) control substrate C1, the first series of chemical mechanical polish (CMP) product substrates P1, P2, P3 or P4 or the second chemical mechanical polish (CMP) control substrate C2, particularly but not exclusively when the substrate consists of or comprises a semiconductor substrate employed within a semiconductor integrated circuit microelectronic fabrication, may have formed therein and/or. thereupon microelectronic devices as are conventional within the microelectronic fabrication within which is employed the substrate. Such microelectronic devices may include, but are not limited to resistors, transistors, diodes and capacitors.

Within the present invention and the first preferred embodiment of the present invention with respect to the first chemical mechanical polish (CMP) control substrate C1 and the second chemical mechanical polish (CMP) control substrate C2, the first chemical mechanical polish (CMP) control substrate C1 and the second chemical mechanical polish (CMP) control substrate C2 are typically and preferably formed of a substrate having formed thereupon and/or thereover a blanket microelectronic layer of a composition and type which is desired to be chemical mechanical polish (CMP) planarized while employing the method of the present invention. Similarly, within the present invention and the first preferred embodiment of the present invention with respect to the series of chemical mechanical polish (CMP) product substrates P1, P2, P3 and P4, the series of chemical mechanical polish (CMP) product substrates P1, P2, P3 and P4 is typically and preferably formed of a series of substrates analogous or equivalent to the pair of substrates which is employed for forming the first chemical mechanical polish (CMP) control substrate C1 and the second chemical mechanical polish control substrate C2 and also having formed thereupon and/or thereover a blanket microelectronic layer desired to be chemical mechanical polish (CMP) planarized while employing the method of the present invention, but wherein the series of chemical mechanical polish (CMP) product substrates P1, P2, P3 and P4 also has formed therein and/or thereupon a series of microelectronic devices as are conventional within the microelectronic fabrication within which is employed the series of substrates.

Referring again to the schematic process flow diagram of FIG. 1, there is illustrated in conjunction with reference numeral 12 the next process step in accord with the first preferred embodiment of the present invention.

As is illustrated within the process step which corresponds with reference numeral 12, there is sequentially chemical mechanical polish (CMP) planarized, while employing a chemical mechanical polish (CMP) planarizing method: (1) the first chemical mechanical polish (CMP) control substrate C1 (to form a planarized first chemical mechanical polish (CMP) control substrate C1); (2) the first series of chemical mechanical polish (CMP) product substrates P1, P2, P3 and P4 (to form a planarized first series of chemical mechanical polish (CMP) product substrates P1, P2, P3 and P4); and (3) the second chemical mechanical polish (CMP) control substrate C2 (to form a planarized second chemical mechanical polish (CMP) control substrate C2).

Within the present invention and the first preferred embodiment of the present invention, the first chemical mechanical polish (CMP) control substrate C1, the first series of chemical mechanical polish (CMP) product substrates P1, P2, P3 and P4 and the second chemical mechanical polish (CMP) control substrate C2 are chemical mechanical polish (CMP) planarized while employing a chemical mechanical polish (CMP) planarizing method, chemical mechanical polish (CMP) planarizing materials and a chemical mechanical polish (CMP) planarizing apparatus as is otherwise convention in the art of microelectronic fabrication and appropriate for chemical mechanical polish (CMP) planarizing, in general, a microelectronic layer which is formed over or upon the first chemical mechanical polish (CMP) control substrate C1, the first series of chemical mechanical polish (CMP) product substrates P1, P2, P3 and P4 and the second chemical mechanical polish (CMP) control substrate C2.

Referring again to FIG. 1, there is shown in conjunction with reference numeral 14 the next process step in accord with the first preferred embodiment of the present invention.

As is illustrated by the process step which corresponds with reference numeral 14, there is determined for the first chemical mechanical polish (CMP) control substrate C1 and the second chemical mechanical polish (CMP) control substrate C2 a corresponding first value of a chemical mechanical polish (CMP) parameter within the chemical mechanical polish (CMP) planarizing method and a corresponding second value of the chemical mechanical polish (CMP) parameter within the chemical mechanical polish (CMP) planarizing method.

Within the present invention and the first preferred embodiment of the present invention with respect to the chemical mechanical polish (CMP) parameter within the chemical mechanical polish (CMP) planarizing method, the chemical mechanical polish (CMP) parameter may be any parameter which is conventionally measured within a chemical mechanical polish (CMP) planarizing method. Typically and preferably, the chemical mechanical polish (CMP) parameter is selected from the group including but not limited to a chemical mechanical polish (CMP) polishing rate (or related derivative parameter such as but not limited to a blanket microelectronic layer thickness remaining after chemical mechanical polish (CMP) planarizing same in accord with the first preferred embodiment of the present invention) and a chemical mechanical polish (CMP) planarizing uniformity. Typically and preferably, but not exclusively, the first value of the chemical mechanical polish (CMP) parameter and the second value of the chemical mechanical polish (CMP) parameter are determined off-line for the first chemical mechanical polish (CMP) control substrate C1 and the second chemical mechanical polish (CMP) control substrate C2.

Referring again to FIG. 1, there is shown in conjunction with reference numeral 16 the last process step in accord with the first preferred embodiment of the present invention.

As is illustrated by the process step which corresponds with reference numeral 16, there is then interpolated between the first value of the chemical mechanical polish (CMP) parameter and the second value of the chemical mechanical polish (CMP) parameter to provide an interpolated value of the chemical mechanical polish (CMP) parameter which corresponds with a chemical mechanical polish (CMP) product substrate within the series of chemical mechanical polish (CMP) product substrates P1, P2, P3 and P4.

Within the present invention and the preferred embodiment of the present invention, the interpolated value of the chemical mechanical, polish (CMP) parameter may be of value when further processing the chemical mechanical polish (CMP) product substrate within the series of chemical mechanical polish (CMP) product substrates P1, P2, P3 and P4 insofar as knowledge of the interpolated value for the chemical mechanical polish (CMP) parameter for the chemical mechanical polish (CMP) product substrate within the series of chemical mechanical polish (CMP) product substrates P1, P2, P3 and P4 may provide for process modifications when further processing the chemical mechanical polish (CMP) product substrate within the series of chemical mechanical polish (CMP) product substrates P1, P2, P3 and 24.

Second Preferred Embodiment

Figure 2:
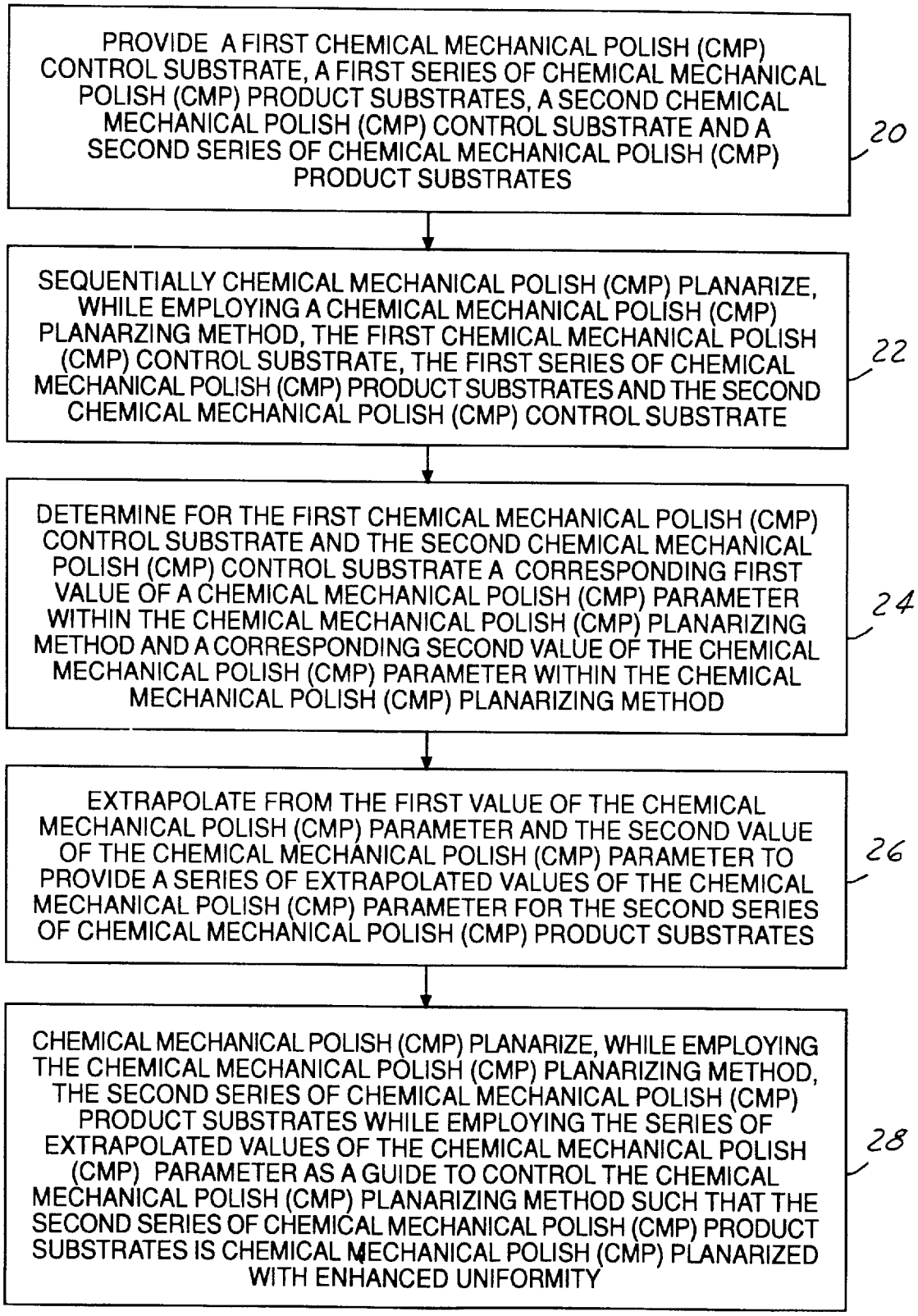
FIG. 2 shows a schematic process flow diagram which defines a series of process steps in accord with a second preferred embodiment of the present invention.

Referring now to FIG. 2, there is shown a schematic process flow diagram defining a series of process step in accord with a second preferred embodiment of the present invention.

Shown in FIG. 2, and in conjunction with reference numeral 20, is a first process step in accord with the second preferred embodiment of the present invention.

As is shown within the process step which corresponds with reference numeral 20, there is first provided within the second preferred embodiment of the present invention a first chemical mechanical polish (CMP) control substrate, a first series of chemical mechanical polish (CMP) product substrates, a second chemical mechanical polish (CMP) control substrate and a second series of chemical mechanical polish (CMP) product substrates.

Thus, as is understood by a person skilled in the art, the second preferred embodiment of the present invention initially differs from the first preferred embodiment of the present invention only with respect to the existence and provision of a second series of chemical mechanical polish (CMP) product substrates. For purposes of further illustration, the second series of chemical mechanical polish (CMP) product substrates is illustrated within the schematic flow diagram of FIG. 3 as the second series of chemical mechanical polish (CMP) product, substrates P5, P6, P7 and P8. The second series of chemical mechanical polish (CMP) product substrates P5, P6, P7 and P8 is otherwise formed employing methods, materials and dimensions analogous or equivalent to the methods, materials and dimensions employed for forming the first series of chemical mechanical polish (CMP) product substrates P1, P2, P3 and P4.

Referring again to FIG. 2, there is shown in conjunction with reference numeral 22 the next process step in accord with the second preferred embodiment of the present invention.

As is shown within the process step which corresponds with reference numeral 22, there is sequentially chemical mechanical polish (CMP) planarized, while employing a chemical mechanical polish (CMP) planarizing method, the first chemical mechanical polish (CMP) control substrate C1, the first series of chemical mechanical polish (CMP) product substrates P1 P2, P3 and P4 and the second chemical mechanical polish (CMP) control substrate C2.

As is understood by a person skilled in the art, the process step as disclosed in conjunction with reference numeral 22 within the second preferred embodiment of the present invention corresponds with the process Step as disclosed in conjunction with reference numeral 12 within the first preferred embodiment of the present invention.

Referring again to FIG. 2, there is shown in conjunction with reference numeral 24 the next process step in accord with the second preferred embodiment of the present invention.

As is shown within the process step which corresponds with reference numeral 24, there is then determined for the first chemical mechanical polish (CMP) control substrate C1 and the second chemical mechanical polish (CMP) control substrate C2 a corresponding first value of a chemical mechanical polish (CMP) parameter within the chemical mechanical polish (CMP) planarizing method and a corresponding second value of the chemical mechanical polish (CMP) parameter within the chemical mechanical polish (CMP) planarizing method.

As is understood by a person skilled in the art, the process step which corresponds with reference numeral 24 within the second preferred embodiment of the present invention corresponds with the process step which corresponds with reference numeral 14 within the first preferred embodiment of the present invention.

Referring again to FIG. 2, there is shown in conjunction with reference numeral 26 the next process step in accord with the second preferred embodiment of the present invention.

As is shown within the process step which corresponds with reference numeral 26, there is then extrapolated from the first value of the chemical mechanical polish (CMP) parameter and the second value of the chemical mechanical polish (CMP) parameter to provide a series of extrapolated values of the chemical mechanical polish (CMP) parameter for the second series of chemical mechanical polish (CMP) product substrates P5, P6, P7 and P8.

As is understood by a person skilled in the art, the process step which corresponds with reference numeral 26 within the second preferred embodiment of the present invention corresponds generally with the process step which corresponds with reference numeral 16 within the first preferred embodiment of the present invention, but with the exception that there is employed an extrapolation with respect to a second series of chemical mechanical polish (CMP) product substrates P5, P6, P7 and P8 not yet planarized, rather than an interpolation with respect to a first series of chemical mechanical polish (CMP) product substrates P1, P2, P3 and P4 which have already been planarized.

Referring finally again to the schematic process flow diagram of FIG. 2, there is shown in conjunction with reference numeral 28 the last process step in accord with the second preferred embodiment of the present invention.

As is shown within the process step which corresponds with reference numeral 28, there is chemical mechanical polish (CMP) planarized the second series of chemical mechanical polish (CMP) product substrates P5, P6, P7 and P8 while employing the series of extrapolated values of the chemical mechanical polish (CMP) parameter as a guide to control the chemical mechanical polish (CMP) planarizing method such that the second series of chemical mechanical polish (CMP) product substrates P5, P6, P7 and P8 is chemical mechanical polish (CMP) planarized with enhanced uniformity.

As is understood by a person skilled in the art, typically and preferably, and in accord with the first preferred embodiment of the present invention, the measured parameter is selected from the group including but not limited to a chemical mechanical polish (CMP) planarizing rate (or a derivative parameter such as a planarized blanket microelectronic layer thickness) and a chemical mechanical polish (CMP) planarizing uniformity.

As is further understood by a person skilled in the art, although the present invention and the preferred embodiments of the present invention illustrate the present invention within the context of an impliedly single first chemical mechanical polish (CMP) control substrate, an impliedly first series of single chemical mechanical polish (CMP) product substrates, an impliedly single second chemical mechanical polish (CMP) control substrate and an impliedly second series of single chemical mechanical polish CMP) product substrates, it is typical and common in the art of microelectronic fabrication that chemical mechanical polish (CMP) product substrates will be processed in lots of up to about 25 chemical mechanical polish (CMP) product substrates at a single time, while employing a single chemical mechanical polish (CMP) planarizing apparatus. Thus, the present invention and the preferred embodiments of the present invention, as disclosed and claimed, are intended to include chemical mechanical polish (CMP) control substrates and chemical mechanical polish (CMP) product substrates which are chemical mechanical polish (CMP) planarized within a chemical mechanical polish (CMP) planarizing method as either single substrates or within multiple substrate lots of substrates as in conventional within the art of chemical mechanical polish (CMP) planarizing processing.

As is still further understood by a person skilled in the art, by employing within the preferred embodiments of the present invention an interpolation or an extrapolation of a chemical mechanical polish (CMP) parameter in accord with the preferred embodiments of the present invention, there is provided an interpolated or extrapolated value of the chemical mechanical polish (CMP) parameter with respect to a chemical mechanical polish (CMP) product substrate such that the chemical mechanical polish (CMP) product substrate may be fabricated with enhanced uniformity.

Finally, as is yet still further understood by a person skilled in the art, while the preferred embodiments of the present invention employ the terms "interpolate" and "extrapolate" generally with respect to determination of an interpolated or extrapolated value of a chemical mechanical polish (CMP) parameter, such interpolation or extrapolation may be effected employing linear regression analyses (which employ directly the slope of a line between a first value of a chemical mechanical polish (CMP) parameter and a second chemical mechanical polish (CMP) parameter as divided and weighted by a number of chemical mechanical polish (CMP) product substrates disposed therebetween) or alternative curve filling methods (particularly under circumstances when extrapolating from a greater number of values for a chemical mechanical polish (CMP) parameter).

EXAMPLE

Figure 4:
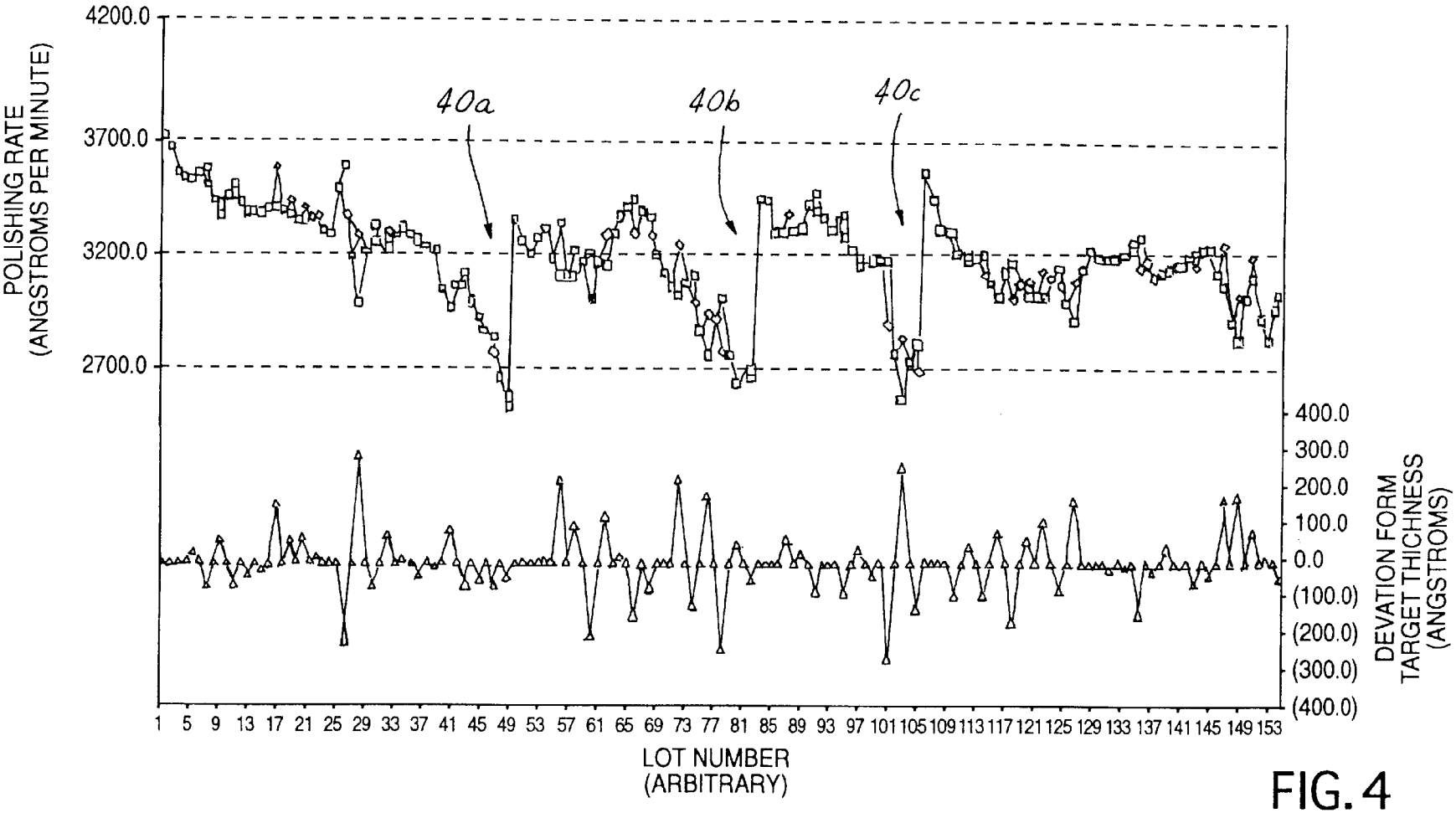
FIG. 4 shows a composite graph illustrating: (1) Polishing Rate versus Lot Number; and (2) Deviation From Target Thickness versus Lot Number, for a series of lots of chemical mechanical polish (CMP) planarized substrates in accord with an example of the present invention.

Referring now to FIG. 4, there is shown a composite graph illustrating: (1) Polishing Rate versus Lot Number; and (2) Deviation From Target Thickness versus Lot Number, for a series of chemical mechanical polish (CMP) planarized product substrates which are chemical mechanical polish (CMP) planarized in accord with the preferred embodiments of the present invention. In order to provide the data which is graphed in FIG. 4, there was chemical mechanical polish (CMP) planarized a series of silicon oxide dielectric layers formed over a series of silicon semiconductor substrates.

Within the context of the example whose data is graphed in FIG. 4, there was employed within a chemical mechanical polish (CMP) planarizing method a chemical mechanical polish (CMP) control substrate with every fourth lot of chemical mechanical polish (CMP) product substrates, where each lot of chemical mechanical polish (CMP) product substrates comprised twenty-five chemical mechanical polish (CMP) product substrates. Further within the context of the example whose data is graphed in FIG. 4, chemical mechanical polish (CMP) polishing rate data was actually measured for each of the chemical mechanical polish (CMP) planarized product substrates, but nonetheless control of the chemical mechanical polish (CMP) planarizing method was undertaken employing an interpolation or extrapolation of a chemical mechanical polish (CMP) polishing rate as a measured parameter to provide guidance and control of a chemical mechanical polish planarizing time.

As is illustrated within the plot of Polishing Rate versus Lot Number data within the upper plot within the graph of FIG. 4, there is shown three discontinuities 40*a*, 40*b* and 40*c*, which derive from a preventative maintenance of the chemical mechanical polish (CMP) planarizing apparatus, wherein primarily, the chemical mechanical polish (CMP) polishing pad was reconditioned or replaced, which in general provided for a higher polishing rate within the chemical mechanical polish (CMP) planarizing method after reconditioning or replacement of the chemical mechanical polish (CMP) polishing pad.

As is illustrated within the plot of Deviation From Target Thickness versus Lot Number within the lower portion of the graph of FIG. 4, there is shown that even in the presence of substantial and discernable variations in polishing rate of the microelectronic layers formed upon the chemical mechanical polish (CMP) product substrates, there is not observed a correlating discontinuity in a deviation of a chemical mechanical polish (CMP) planarized layer thickness from a target thickness of the chemical mechanical polish (CMP) layer.

As is understood by a person skilled in the art, the preferred embodiments and examples of the present invention are illustrative of the present invention rather than limiting of the present invention. Revisions and modifications may be made to methods, materials, structures and dimensions through which is provided a chemical mechanical polish (CMP) planarizing method in accord with the present invention, further in accord with the accompanying claims.

What is claimed is:

1. A chemical mechanical polish (CMP) method comprising:

providing a first control substrate, a first series of product substrates and a second control substrate;

sequentially chemical mechanical polish (CMP) planarizing, while employing a chemical mechanical polish (CMP) planarizing method, the first control substrate to provide a planarized first control substrate, the first series of product substrates to provide a planarized first series of product substrates and the second control substrate to provide a planarized second control substrate;

determining for the planarized first control substrate and the planarized second control substrate a corresponding first value of a parameter within the chemical mechanical polish (CMP) planarizing method and a corresponding second value of the parameter within the chemical mechanical polish (CMP) planarizing method; and interpolating between the first value of the parameter and the second value of the parameter to determine an interpolated value of the parameter which corresponds with a planarized first product substrate within the planarized first series of product substrates.

2. The method of claim 1 wherein the first series of product substrates comprises from about 4 to about 8 product substrates.

3. The method of claim 1 wherein the control substrates and the product substrates are selected from the group consisting of integrated circuit microelectronic fabrication substrates, ceramic substrate microelectronic fabrication substrates, solar cell optoelectronic microelectronic fabrication substrates, sensor image array optoelectronic microelectronic fabrication substrates and display image array optoelectronic microelectronic fabrication substrates.

4. The method of claim 1 wherein the parameter is selected from the group consisting of a chemical mechanical polish (CMP) polishing rate and a chemical mechanical polish (CMP) planarization uniformity.

5. The method of claim 1 wherein each of the substrates comprises a microelectronic layer which is chemical mechanical polish (CMP) planarized.

6. The method of claim 5 wherein the microelectronic layer is formed from a microelectronic material selected from the group consisting of microelectronic conductor materials, microelectronic semiconductor materials and microelectronic dielectric materials.

7. The method of claim 6 wherein the microelectronic layer is formed to a thickness of from about 2,000 to about 20,000 angstroms.

8. A chemical mechanical polish (CMP) method comprising:

providing a first control substrate, a first series of product substrates, a second control substrate and a second series of product substrates;

sequentially chemical mechanical polish (CMP) planarizing, while employing a chemical mechanical polish (CMP) planarizing method, the first control substrate to provide a planarized first control substrate, the first series of product substrates to provide a planarized first series of product substrates and the second control substrate to provide a planarized second control substrate;

determining for the planarized first control substrate and the planarized second control substrate a corresponding first value of a parameter within the chemical mechanical polish (CMP) planarizing method and a corresponding second value of the parameter within the chemical mechanical polish (CMP) planarizing method; and extrapolating from the first value of the chemical mechanical polish (CMP) parameter and the second value of the chemical mechanical polish (CMP) parameter to provide an extrapolated value of the chemical mechanical polish (CMP) parameter for a second product substrate within the series of second product substrates.

9. The method of claim 8 further comprising chemical mechanical polish (CMP) planarizing, while employing the chemical mechanical polish (CMP) planarizing method, the second chemical mechanical polish (CMP) product substrate while employing the extrapolated value of the chemical mechanical polish (CMP) parameter as a guide to control the chemical mechanical polish (CMP) planarizing method such that the second product substrate is planarized with enhanced uniformity.

10. The method of claim 8 wherein the first series of product substrates comprises from about 4 to about 8 product substrates.

11. The method of claim 8 wherein the control substrates and the product substrates are selected from the group consisting of integrated circuit microelectronic fabrication substrates, ceramic substrate microelectronic fabrication substrates, solar cell optoelectronic microelectronic fabrication substrates, sensor image array optoelectronic microelectronic fabrication substrates and display image array optoelectronic microelectronic fabrication substrates.

12. The method of claim 8 wherein the chemical mechanical polish (CMP) parameter is selected from the group consisting of a chemical mechanical polish (CMP) polishing rate and a chemical mechanical polish (CMP) planarization uniformity.

13. The method of claim 8 wherein each of the substrates comprises a microelectronic layer which is chemical mechanical polish (CMP) planarized.

14. The method of claim 13 wherein the microelectronic layer is formed from a microelectronic material selected from the group consisting of microelectronic conductor materials, microelectronic semiconductor materials and microelectronic dielectric materials.

15. The method of claim 14 wherein the microelectronic layer is formed to a thickness of from about 2,000 to about 20,000 angstroms.

* * * * *